United States Patent [19]

Hill

[11] 3,948,057

[45] Apr. 6, 1976

[54] PORTABLE MINE STOPPING DEVICE

[75] Inventor: Hugo Hill, Rock Spring, Wyo.

[73] Assignee: The Raymond Lee Organization, Inc., New York, N.Y. ; a part interest

[22] Filed: Feb. 24, 1975

[21] Appl. No.: 552,175

[52] U.S. Cl. ..... 61/45 F; 49/34; 98/50

[51] Int. Cl.[2] ..... E21F 17/00; E21F 1/14

[58] Field of Search ..... 61/45; 98/50; 49/34; 299/12

[56] References Cited

UNITED STATES PATENTS 2,729,064 1/1956 Kennedy et al. ..... 61/45 R 3,831,318 8/1974 Richmond ..... 49/34 X

*Primary Examiner*—Jacob Shapiro

*Attorney, Agent, or Firm*—Daniel Jay Tick

[57] ABSTRACT

A ribbed sheet of flowable material is positionable on the sides and roof of an air passage of a mine for sealing irregularities in the sides and roof and extends across the air passage to prevent the flow of air therealong. A plurality of air cells are positioned in closely adjacent relation within the confines of the sheet and are inflatable to block the flow of air through the passage.

2 Claims, 2 Drawing Figures

PORTABLE MINE STOPPING DEVICE

DESCRIPTION OF THE INVENTION

The present invention relates to a portable mine stopping device. More particularly, the invention relates to a portable mine stopping device for blocking an air passage of a mine.

Objects of the invention are to provide a portable mine stopping device of simple structure, which is inexpensive in manufacture, portable, light in weight, assembled and disassembled with convenience and facility in a minimum time utilizing a minimum amount of manpower and minimal equipment and tools, and functions efficiently, effectively and reliably to effectively block the flow of air through an air passage of a mine.

Figure 1:
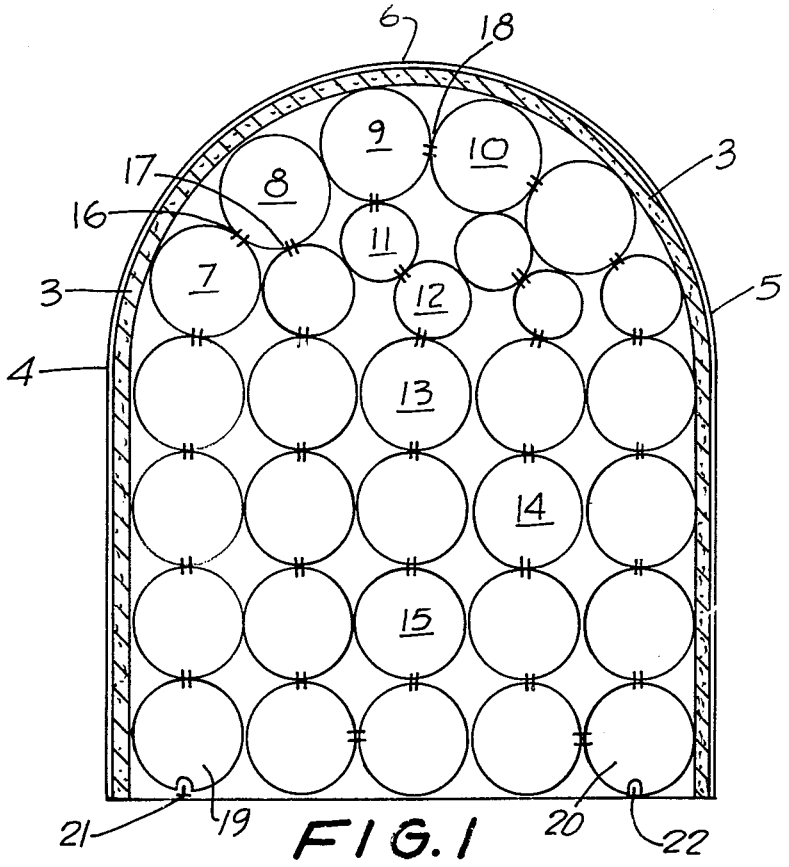
Figure 2:
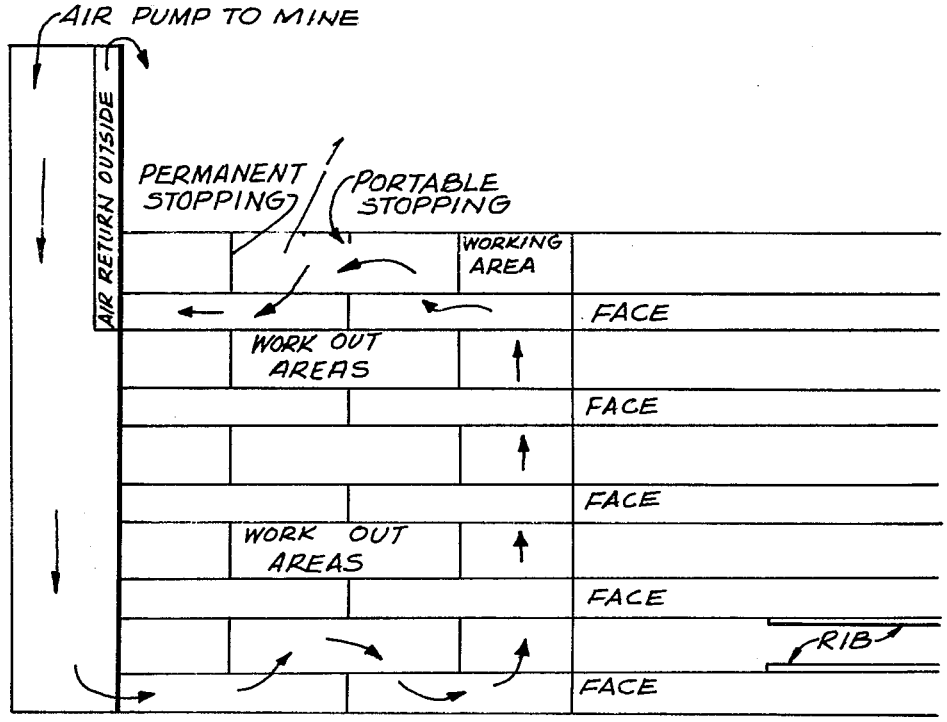

In order that the invention may be readily carried into effect, it will now be described with reference to the accompanying drawing, wherein:

FIG. 1 is a schematic diagram, partly in section, of an embodiment of the portable mine stopping device of the invention; and FIG. 2 is a schematic diagram illustrating the layout of a mine utilizing the mine stopping device of the invention.

The portable mine stopping device of the invention is for blocking an air passage such as, for example, an air passage 1 (FIG. 2) of a mine 2.

The portable mine stopping device of the invention comprises a ribbed sheet 3 of flowable materials such as, for example, yieldable rubber, positionable on the sides 4 and 5 and the roof 6 of an air passage of a mine, as shown in FIG. 1. The sheet 3 functions to seal irregularities or unevenness in the sides and roof and extends across the air passage to prevent the flow of air therealong.

A plurality of air cells 7, 8, 9, 10, 11, 12, 13, 14, 15, and so on, are positioned in closely adjacent relation within the confines of the sheet 3, as shown in FIG. 1. The air cells are inflatable to substantially block the flow of air through the passage. The envelopes 7 to 15, and so on, are interconnected by ducts 16, 17, 18, and so on. An air cell 19 and/or an envelope 20 has a valve 21 and a valve 22, respectively, for supplying air thereto and to the other air cell therethrough.

While the invention has been described by means of a specific example and in a specific embodiment, I do not wish to be limited thereto, for obvious modifications will occur to those skilled in the art without departing from the spirit and scope of the invention.

I claim:

1. A portable mine stopping device for blocking an air passage of a mine, said mine stopping device comprising a ribbed sheet of flowable material positionable on the sides and roof of an air passage of a mine for sealing irregularities in the sides and roof and extending across the air passage to prevent the flow of air therealong; and a plurality of air cells positioned in closely adjacent relation within the confines of the sheet, said air cells being inflatable to substantially block the flow of air through the passage.

2. A portable mine stopping as claimed in claim 1, wherein the air cells are interconnected by ducts and at least one of the air cells has valve means for supplying air thereto and to the other air cells therethrough.

* * * * *